United States Patent [19]

Foreman et al.

[11] 4,117,445

[45] Sep. 26, 1978

[54] POWER REGULATOR

[75] Inventors: Luther M. Foreman; Samuel C. Heck, both of San Antonio; Bill R. Wall, Bulverde, all of Tex.

[73] Assignee: National Electric Corporation, San Antonio, Tex.

[21] Appl. No.: 796,857

[22] Filed: May 16, 1977

[51] Int. Cl.[2] ..... H01C 10/50

[52] U.S. Cl. ..... 338/198; 338/172; 338/199; 338/200; 338/202

[58] Field of Search ..... 338/160–162, 338/165, 159, 167, 171, 174, 176, 183, 191, 194, 198, 199, 200, 202; 200/153 G, 153 L, 153 LB

[56] References Cited

U.S. PATENT DOCUMENTS

| | | | |
|---|---|---|---|
| 2,903,531 | 9/1959 | Winter | 200/153 L X |
| 3,310,768 | 3/1967 | Opalenik et al. | 338/198 |
| 3,413,430 | 11/1968 | Sharples | 200/153 L |
| 3,634,805 | 1/1972 | Jestrzemski | 338/183 X |
| 3,871,328 | 1/1959 | Budd et al. | 338/202 X |
| 3,990,033 | 11/1976 | Wall | 338/200 |

*Primary Examiner*—C. L. Albritton

*Attorney, Agent, or Firm*—Arnold, White & Durkee

[57] ABSTRACT

A toggle-type power regulator is adapted to shunt or open a power control circuit at opposite limit positions and has infinitely variable power control at all intermediate positions between the limit positions. A potentiometer incorporated in the control circuit comprises a pair of arcuate tracks of resistive and conductive material positioned on opposite faces of the control circuit substrate. Variable voltage output is achieved as the tracks are engaged or wiped by the opposed resilient contactors of a caliper which is connected for movement by the toggle. The regulator includes a one-piece dual blade switch assembly through which the toggle is yieldably held in the intermediate positions at which reduced power is supplied to the load.

27 Claims, 11 Drawing Figures

Fig. 6
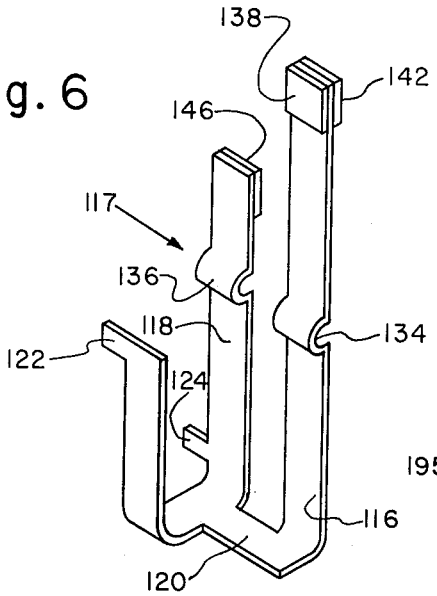
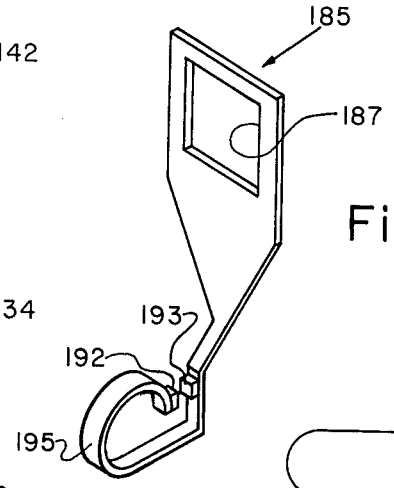
Fig. 7
Fig. 4
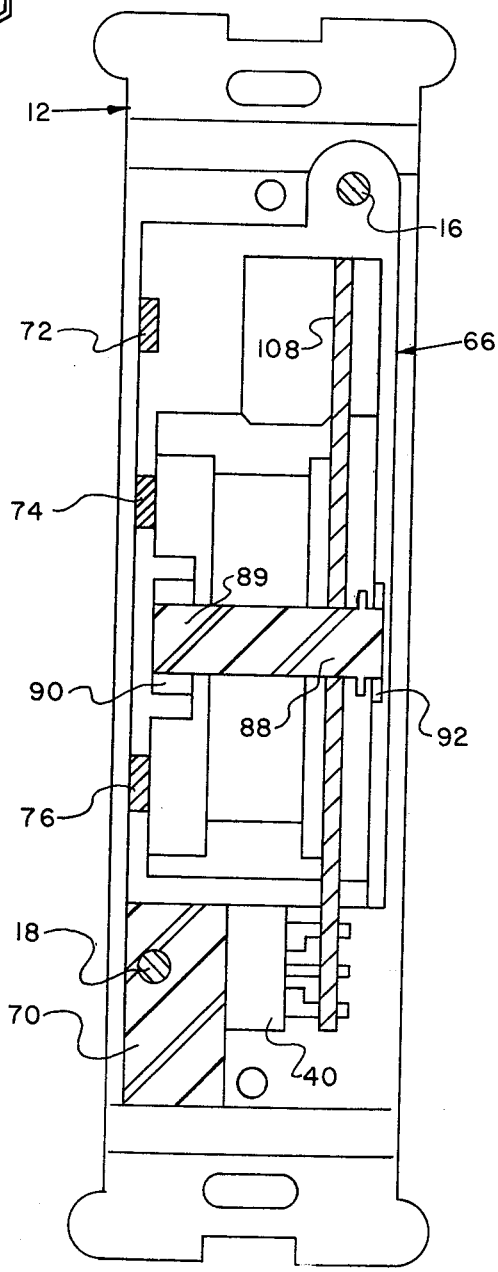
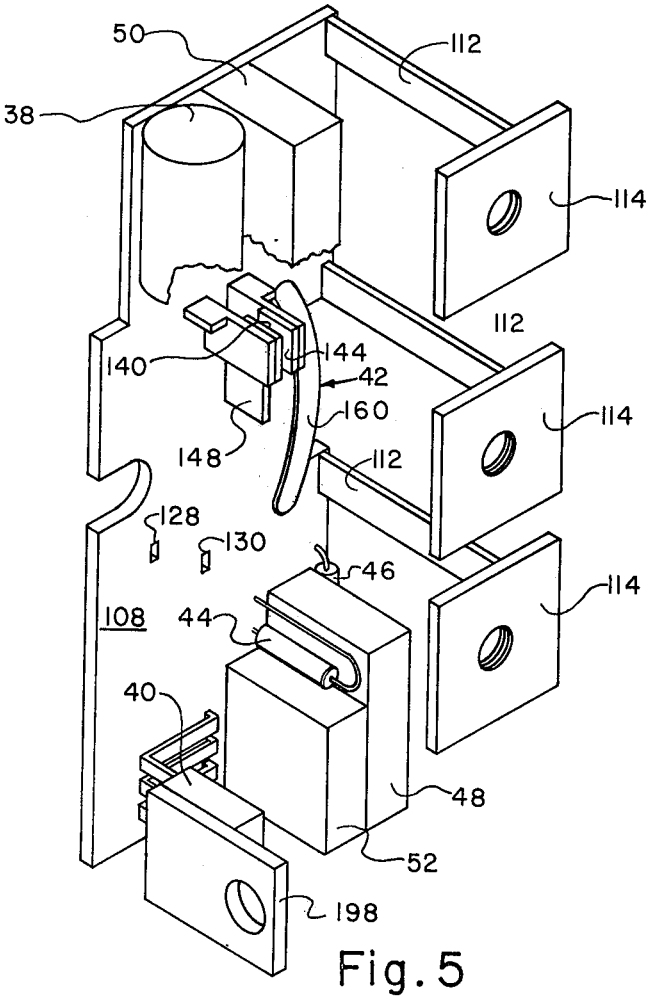
Fig. 5

POWER REGULATOR

BACKGROUND OF THE INVENTION

1. Field of the Invention

The invention relates to power regulators for loads of relatively low voltage consumption, and more particularly, to wall-mounted, toggle-type dimmer switches for controlling incandescent lamps.

2. Description of the Prior Art

Incandescent light dimmer switches have traditionally taken the form of relatively large devices having circular control knobs adapted for rotation between the on-off limit positions. Such devices generally include a potentiometer forming part of the power control circuitry. A primary disadvantage of all known devices of this type is that they are considerably larger than standard household toggle-type switches and, therefore, require special installation procedures.

Also known are light dimmers which include a pivoted control lever that is associated with a potentiometer for varying the power supply to a load as the control lever is displaced between opposite limit positions at which switch contacts are actuated in order to open and close the power control circuit. In such prior power control devices, for example the device disclosed in U.S. Pat. No. 3,990,033, the circuit opening and closing switch mechanism is actuated by the wiper arm associated with the potentiometer, and the potentiometer is relied upon to frictionally hold the control lever in its intermediate position. Further, detent devices have been required to hold the control lever in its limit positions. Relatively complex arrangements were therefore required for the power control devices making fabrication expensive and operation unreliable because of the functional interdependence of the potentiometer and switch operations.

SUMMARY OF THE INVENTION

In accordance with the present invention, switch operation for opening and closing the power regulator circuit is accomplished independently of the resistance varying operation associated with the potentiometer, from a structural and locational standpoint. Further, the yieldable holding function heretofore associated with the potentiometer is transferred to the switch assembly so as to avoid excessive wear of the potentiometer portion of the power control device and make operation more reliable in general. Toward that end, the toggle member has a cam assembly associated therewith including a frictional surface continuously engaged with a pair of elastically deformable blades of a one-piece switch operating member anchored to the substrate on which components of the power control circuit are mounted. Movable contacts are carried by the free end portions of the deformable blades for engagement with fixed contacts also carried by the substrate and forming part of the switch assembly located remotely from the potentiometer and operated independently thereof. Cam lobes associated with the cam assembly engage dimple formations on the switch blades in the opposite limit positions of the controller lever to elastically deform the blades for switch operation as well as to yieldably hold the toggle member in position.

The potentiometer includes a pair of arcuate tracks deposited on opposite surfaces of the substrate. A caliper which is movable by the toggle member has a pair of resilient contactors which wipe the tracks as the toggle member moves between the limit positions in order to produce the variable resistance associated with the potentiometer.

When properly positioned within the enclosure section of the housing, slots formed in the substrate receive elongated terminal connector lugs associated with terminal assemblies locked in place on one side of the housing by assembly of the main enclosure section of the housing with a closure section through which the control arm of the toggle member projects and by means of which positive limit positions for the toggle member are established. Each of the terminal assemblies includes a lug head from which the connector lug extends, the lug heads being seated in slots formed in the main enclosure section abutting locking tabs projecting from the closure section into the slots receiving the lug heads. The sections of the housing are held assembled by fasteners through which the closure section is secured to a mounting bracket strap.

BRIEF DESCRIPTION OF THE DRAWINGS

FIG. 4 is a transverse sectional view taken substantially along section line 4—4 in FIG. 3.

FIG. 5 is a perspective view showing the substrate associated with the power regulator with selected components mounted thereon including the potentiometer tracks.

FIG. 6 is a perspective view showing the dual-blade switch operating member associated with the power regulator.

FIG. 7 is a perspective view of the caliper member which is associated with the potentiometer of the present invention.

DETAILED DESCRIPTION OF A PREFERRED EMBODIMENT

Figure 1:
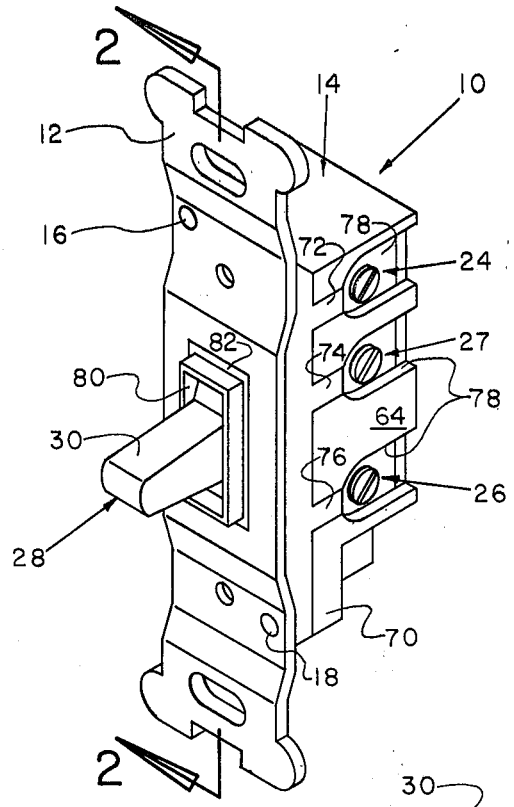
FIG. 1 is a perspective view illustrating a power regulator contructed according to the present invention.

Referring now to the drawings and in particular to FIG. 1, there is shown a power regulator 10 having external physical features common to ordinary household wall switches thereby adapting the regulator 10 for mounting in a conventional manner. Associated with the power regulator is a metallic mounting bracket generally referred to by reference numeral 12 which is similar to mounting brackets associated with conventional electric switches. The mounting bracket 12 supports a non-conductive housing assembly 14 secured thereto by means of fasteners 16 and 18. As explained in detail below, the mounting bracket also serves as a heat sink for the semiconductor components utilized in a phase shift control circuit 20 diagrammed in FIG. 10.

Power supplied to a load 22, such as an incandescent lamp, from an AC voltage source applied across power terminals 24 and 26 may be infinitely varied for power variation for light dimming purposes or the like. The power terminals 24 and 26 and a third terminal 27 are mounted on the housing assembly 14 as shown in FIG. 1. A one-piece toggle member made of non-conductive material and generally referred to by reference numeral 28 has a control arm 30 projecting from the mounting strap 12 externally of the housing assembly so that it may be manually displaced between opposite limit positions. In the lower "off" limit position the toggle member 28 is operative to open the power control circuit as in the case of a conventional electric switch, and in its upper "on" limit position it is operative to establish a full-power connection from the power source across the load. Unlike a conventional switch, however, the toggle member 28 will remain stationary in any adjusted position to which it is displaced intermediate the upper and lower limit positions to establish a reduced power connection for light dimming purposes, for example. The power regulator 10 may therefore be installed, electrically connected and operated in a manner similar to that associated with conventional wall-mounted household electric switches except that it includes an additional light dimming function.

Figure 10:
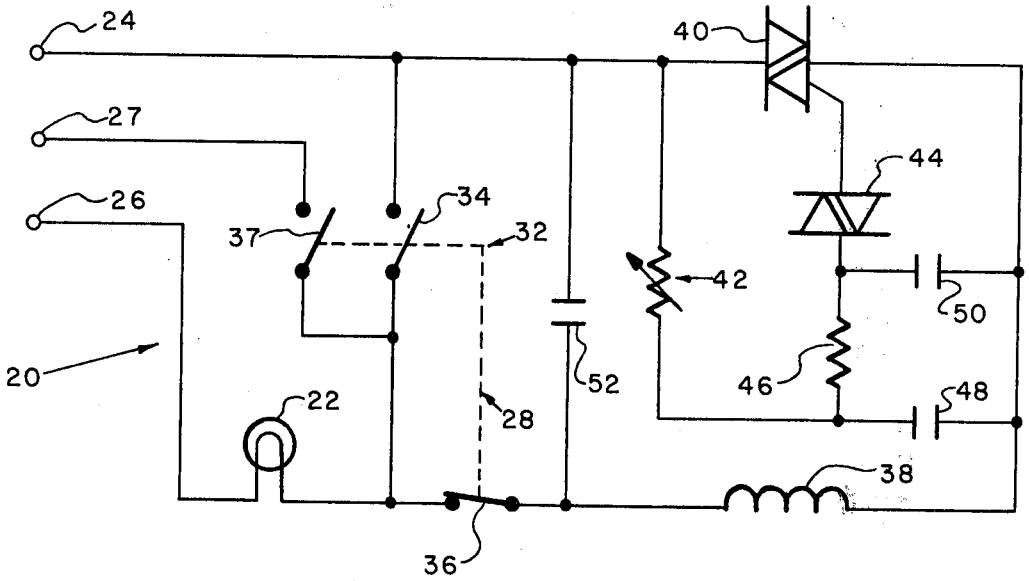
FIG. 10 is an electrical circuit diagram corresponding to one form of the power regulator circuit associated with the power regulator of the present invention.

The typical power control circuit 20 as shown in FIG. 10 is enclosed within the housing assembly 14 of the power regulator and includes a switch assembly 32 actuated by the toggle member 28 in its opposite limit positions to either close a normally opened switch section 34 or open a normally closed switch section 36. A third switch section 37 is closed whenever switch section 36 is opened to establish a hot line connection to another switch or power control location through terminal 27 aforementioned. The normally closed switch section 36 completes a power circuit through the load 22 in series with choke 38 and triac 40. The current conducted through the triac 40 is controlled by an adjustable resistance potentiometer generally referred to by reference numeral 42. Toward that end, the trigger control electrode of the triac 40 is connected through a diac trigger device 44 to one side of the triac in series with a fixed resistor 46 and the potentiometer 42. The appropriate potential bias on the other side of the triac is established through capacitors 48 and 50 also connected to opposite sides of the fixed resistor 46. A filter capacitor 52 is connected between the output side of the normally closed switch 36 and the power terminal 24 to which the output side of the triac 40 is connected. Thus, with the switch section 36 closed as shown in FIG. 10, the amount of power conducted through the load 22 will depend upon the setting of the potentiometer 42. As will be explained hereinafter, displacement of the toggle member 28 toward the lower "off" limit position will increase the resistance of the potentiometer 42 toward a miximum value at which point the normally closed switch section 36 is opened in order to open the power control circuit. Displacement of the toggle member in the other direction will conversely decrease the resistance of the potentiometer 42 to a minimum value at which point full power through the load 22 is established by closing of the normally opened switch section 34 connecting the load directly across the power terminals 24 and 26.

Figure 2:
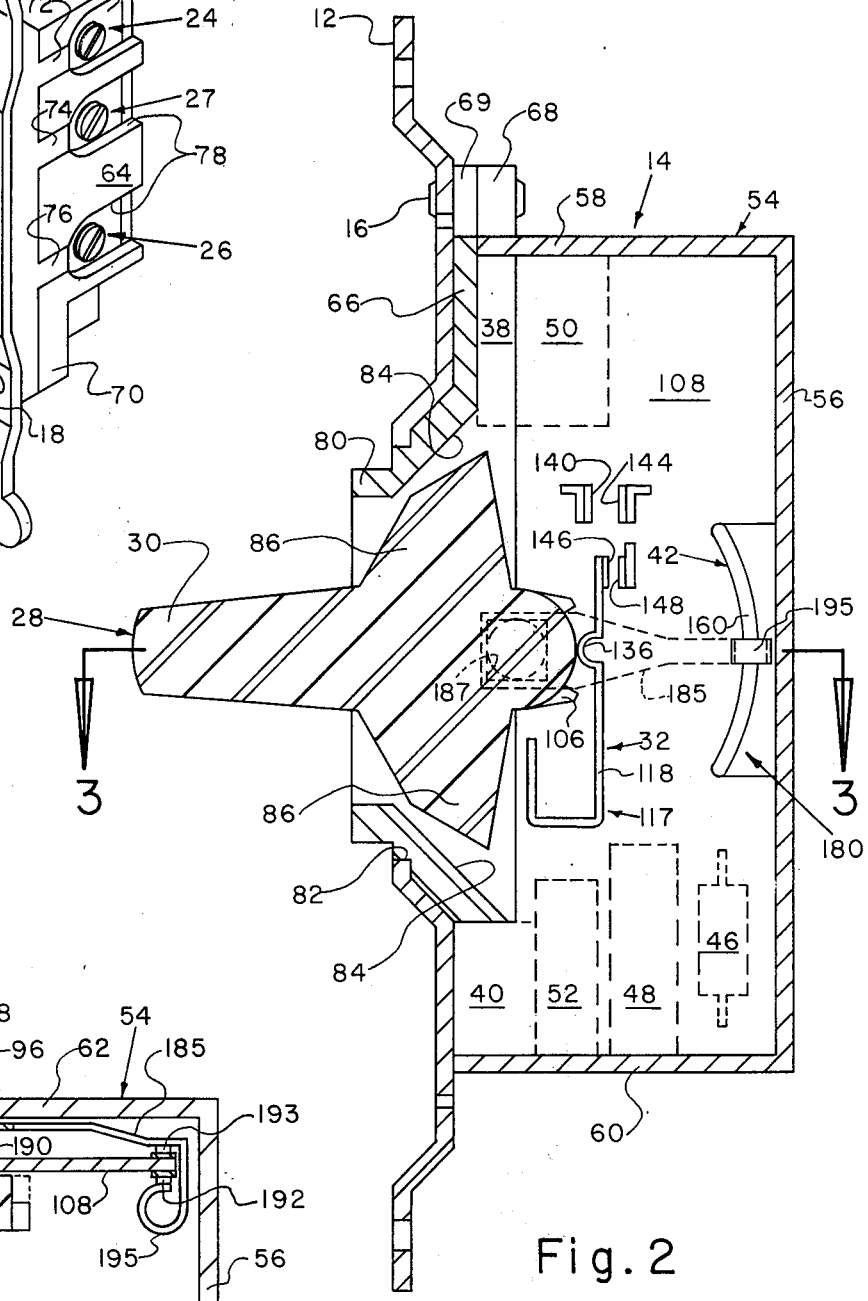
FIG. 2 is an enlarged side sectional view of the power regulator taken substantially along section line 2—2 in FIG. 1.
Figure 3:
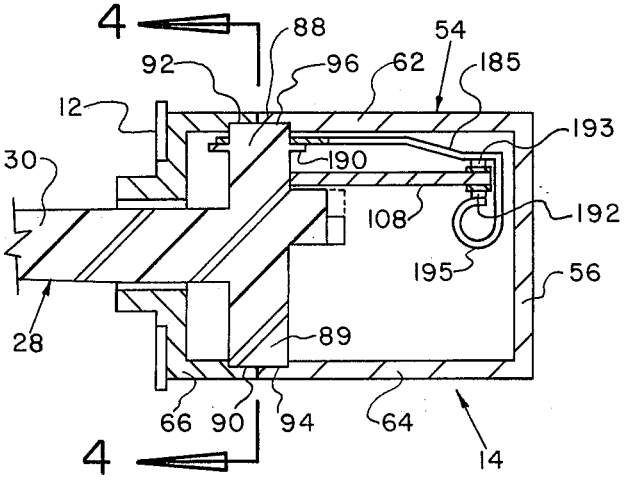
FIG. 3 is a partial top sectional view taken substantially along section line 3—3 in FIG. 2.

The housing assembly 14 is made of an electrically non-conductive material and includes a main enclosure section 54 having a rectangular back wall 56 as shown in FIGS. 2 and 3, interconnected with upper and lower end walls 58 and 60 and with parallel spaced side walls 62 and 64. The main enclosure section 54 has a front opening closed by a closure section generally referred to by reference numeral 66 as also shown in FIGS. 2 and 3. The closure section 66 abuts the main enclosure section 54 along its front peripheral edge formed by the end walls 58 and 60 and side walls 62 and 64 and is interconnected therewith through the fastener 16 extending through a formation 68 on the upper end wall 58 of the enclosure section and an abutting formation 69 of the closure section 66 as shown in FIGS. 2 and 4. A flange 70 projecting from the lower end wall 60 of the main enclosure section 54 is secured by fastener 18 to the mounting bracket strap 12 as more clearly seen in FIGS. 1 and 4. Tabs 72, 74 and 76 project rearwardly from the closure section 66 into slots 78 formed in the side wall 64 of the enclosure section 54 when the sections of the housing assembly 14 are assembled as more clearly seen in FIGS. 1 and 4 to lock the terminals 24, 26 and 27 in place.

Figure 8:
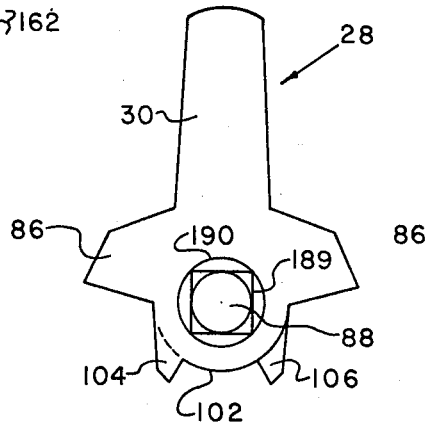
FIG. 8 is a side view of the toggle member showing the hand engageable control arm, pivot shaft and double lobe cam.
Figure 9:
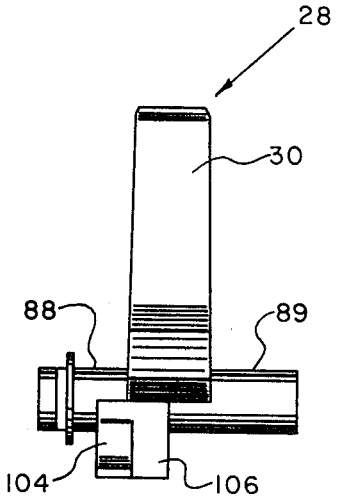
FIG. 9 is an end view of the toggle member shown in FIG. 8.

The closure section 66 includes a rectangular framing portion 80 which projects from a rectangular opening 82 formed in the mounting strap 12. The frame portion 80 of the closure section forms on its vertical sides a spaced fit with the toggle member 28 and is provided internally with upper and lower bevel surfaces 84 as shown in FIG. 2. The bevel surfaces may be used to limit displacement of the controller lever 28 between its upper and lower limit positions. with reference to FIGS. 2, 3, 8 and 9, the toggle member 28 includes in addition to the control arm 30 aforementioned, a pair of wing portions 86 having a pair of pivot shaft sections 88, 89 projecting laterally therefrom. The pivot shaft sections are received within retainer recesses 90 and 92 formed in the closure section 66, the recesses 90 and 92 forming journal retainers with mating recesses 94 and 96 formed in the side walls 64 and 62 of the enclosure section 54 as more clearly seen in FIG. 3. Thus, the toggle member 28 is held between the sections 54 and 66 of the housing assembly for pivotal movement relative thereto. Formed on the pivot shaft sections is a dual-track cam formation 102 having a pair of angularly spaced cam lobes 104 and 106 projecting therefrom as more clearly seen in FIGS. 8 and 9. The cam lobes are also spaced from each other in an axial direction relative to the pivot shaft sections 88, 89 for engagement with the switch assembly 32 in the opposite limit positions of the toggle member to alternatively open or close the power circuit through the normally closed switch section 36 and normally open switch section 34.

The switch assembly 32 is mounted on a circuit board or substrate 108 together with the other components of the power circuit 20. The substrate is held assembled within the enclosure section 54 of the housing assembly abutting back wall 56 and parallel to and closely spaced from side wall 62 by means of suitable positioning guides in order to position the switch assembly 32 and the potentiometer assembly 42 in an operative relationship with respect to the toggle member 28. As shown in FIG. 5, the substrate 108 when properly positioned receives terminal connector lugs 112 which extend from lug heads 114 seated in the slots 78 of the enclosure section 54 as aforementioned. A terminal post screw is in threaded engagement with each lug head 114 to form the terminals 24, 26 and 27. The tabs 72, 74 and 76 abut the lug heads 114 so as to lock the terminals in place in the slots 78 and abutting the back wall 56.

With reference to FIGS. 2 and 6, the switch assembly 32 includes a dual-blade switch operating member generally referred to by reference numeral 117 having a pair of spaced leaf-spring blades 116 and 118 interconnected by an anchoring portion 120 from which two anchoring tabs 122 and 124 extend. The anchoring tabs are received within slots 128 and 130 formed in the substrate 108 as shown in FIG. 5 in order to firmly hold the anchoring end portion 120 of the switch operating member 117 in its operative position with intermediate dimple portions 134 and 136 in contact with the cam formation 102 on the toggle member 28 as shown in FIG. 2. The surface of the cam formation between the cam lobes is thereby operative to create frictional drag and yieldably hold the toggle member 28 in its intermediate adjusted positions without "creep" in spite of external vibrations. The blades 116 and 118 are elastically displaceable from their undeformed positions by the cam lobes in the limit positions of the toggle member. The upper free end of the longer blade 116 is provided with a movable contact element 138 on one side thereof normally engaged with a fixed contact 140 anchored to the substrate 108 as shown in FIGS. 2 and 5. The contact elements 138 and 140 constitute the normally closed switch section 36 aforementioned. Also mounted at the free end of blade 116 on the other side thereof is a movable contact element 142 confronting the contact surface of a second fixed contact element 144 anchored to the circuit board. Movement of toggle member 28 to the down or "off" position results in displacement of the blade 116 by cam lobe 106 which will accordingly open the normally closed switch section 36 and close the switch section 37 aforementioned which is constituted by the contact elements 142 and 144. In the other limit position of the toggle member 28, cam lobe 104 engages the intermediate dimple portion 136 of the shorter blade 118 so as to bring the movable contact element 146 at its upper free end into engagement with the fixed contact 148 anchored to the substrate. The movable contact element 146 and the fixed contact element 148 constitute the normally open switch section 34 aforementioned in connection with FIG. 10.

Figure 11:
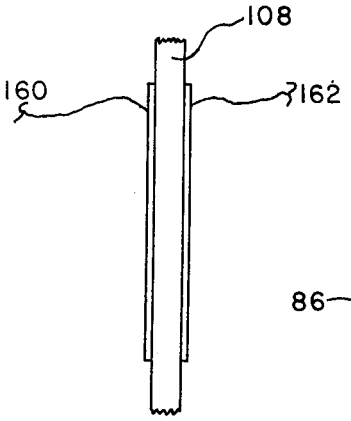
FIG. 11 is an enlarged side view of the portion of the substrate incorporating the potentiometer tracks.

The structure of the potentiometer assembly 42 will now be described with reference to FIGS. 2, 5 and 11. Assembly 42 includes a pair of continuous arcuate tracks 160 and 162 deposited or otherwise secured to opposite surfaces of a correspondingly shaped marginal edge portion 180 of substrate 108. Tracks 160 and 162 are separated by the electrical insulating material of substrate 108. In the illustrated embodiment, track 160 is made of an electrical resistance material deposited on one surface of the substrate and track 162 is made of an electrical conductive material deposited on the opposite surface.

Referring to FIG. 7, a caliper-like member 185 is shown as having a pair of confronting, inwardly biased contact elements 192 and 193 which are adapted to wipingly engage tracks 160 and 162 respectively. Contact elements 192, 193 are formed on opposite ends of a resilient loop portion 195. In its assembled position as shown in FIGS. 2 and 3, member 185 is secured to shaft 88 of toggle member 28 by means of a rectangular opening 187 which fits over a mating boss formation 189 on shaft 88. Member 185 is held on boss formation 189 between journal recesses 92, 96 and a circular disc retainer 190 integrally formed on pivot shaft 88. The contact elements 192, 193 are held in contact with tracks 160, 162 such that loop portion 195 encompasses the arcuate marginal edge portion 180 of substrate 108. As toggle member 28 is moved between the limit positions, member 185 is pivoted by shaft 88 causing contact elements 192, 193 to travel in the arcuate paths defined by tracks 160, 162. As the travel progresses, the firing angle of the phase control circuit is changed by the amount of resistance being fed into the trigger stage of the circuit causing the output power to vary accordingly.

An additional feature of the invention is the provision of means for dissipating heat into the mounting bracket 12. A major portion of the heat build-up in the power circuit during operation at intermediate power output takes place in triac 40. To facilitate dissipation of heat from triac 40 to the outside of the housing, a heat conductive plate 198 (FIG. 5) is secured to the triac 40. The plate 198 lies flush against mounting bracket 12 and is secured thereto by rivet 18 or other suitable fastener. Thus, heat may be readily transferred from triac 40 to plate 198 and then to bracket 12 which serves as a heat sink.

In summary, the art is now provided with a reliable and easily constructed toggle-type power regulator having particular utility as a wall-mounted dimmer switch for household lights. Since numerous modifications and changes will readily occur to those skilled in the art, it is not intended to limit the invention to the exact construction and operation shown and described, and accordingly all suitable modifications and equivalents may be resorted to as they may fall within the scope of the invention.

What is claimed:

1. In a power regulator of the type having a non-conductive housing and a pivotal toggle member for varying the power supply to a load as the toggle member is displaced between opposite on-off limit positions, the improvement comprising:

a substrate secured within said housing and mounting selected components of a control circuit;

a switch operable by the toggle member to shunt or open the control circuit as the toggle is displaced to the respective on-off limit positions;

a potentiometer forming a part of said control circuit and comprising:

a first continuous resistive track on said substrate;

a second continuous conductive track on the opposite face of said substrate from said first track, said second track defining a path substantially identical to the path of said first track and being separated therefrom by a thickness of said substrate;

said first and second tracks defining arcuate paths formed proximate a correspondingly shaped marginal edge portion of the substrate;

contactor means having a pair of confronting inwardly biased contact elements for frictionally engaging each of said first and second tracks, said contactor means being movable by displacement of the toggle member such that said contact elements wipingly engage the tracks along their respective paths as the toggle member is displaced between said on-off limit positions.

2. A power regulator as claimed in claim 1 wherein said contactor means comprises a separate element secured to a pivot shaft of the toggle member.

3. A power regulator as claimed in claim 2 wherein said contactor means has an opening secured over a mating formation on the pivot shaft of the toggle member.

4. A power regulator as claimed in claim 2, wherein said contactor means is characterized by said contact elements being connected by a loop portion which encompasses the marginal edge portion of the substrate as said contact elements move along said tracks.

5. A potentiometer for providing a variable resistance in an electric circuit, comprising:

a non-conductive sheet member;

a first continuous resistive track on said sheet member;

a second continuous conductive track on the opposite face of said sheet member from said first track, said second track defining a path substantially identical to the path of said first track and being separated therefrom by a thickness of said sheet member;

said first and second tracks defining arcuate paths formed proximate a correspondingly shaped marginal edge portion of the sheet member;

a contactor member having a pair of confronting, inwardly biased contact elements for frictionally engaging each of said first and second tracks, said contact elements being movable in response to displacement of an operator member to wipingly engage the tracks along their respective paths thereby providing variable resistance for the electric circuit; and said contactor member comprising a caliper-type member characterized by said contact elements being interconnected by a loop portion which encompasses the marginal edge portion of the sheet member as said contact elements move along said tracks.

6. In combination with a power control circuit, a power regulator having a pair of tracks connected to said circuit and respectively made of conductive and resistive materials, a contactor selectively displaceable between opposite limit positions in continuous wiping contact with said tracks and circuit opening and closing switch means connected to said circuit; a substrate on which the circuit components, the tracks and the switch means are mounted, an enclosure having means for mounting the substrate, a toggle member displaceable between limit positions and having a pivot shaft and a control arm projecting from the enclosure, a mounting strap secured to the enclosure having an opening through which the control arm projects externally of the enclosure, closure means received in the opening of the mounting strap and engageable with the enclosure for retaining the pivot shaft in pivotal relation to the enclosure, and cam means mounted on the pivot shaft internally of the enclosure for engagement with the switch means to alternately open and close the circuit and yieldably hold the toggle member in adjusted positions intermediate said limit positions.

7. The combination of claim 6, wherein said switch means includes a switch operating member mounted on the circuit board and carrying at least two movable contact element in spaced relation to each other, said switch means including at least two fixed contact elements mounted on the circuit board and being alternately engageable by the movable contact elements, said cam means being engageable with the switch operating member to effect alternate displacement of the movable contact elements into engagement with the fixed contact elements.

8. The combination of claim 7, wherein said switch operating member comprises a pair of elastically deformable blades having free end portions on which the movable contact elements are mounted, a common anchored end portion fixed to the circuit board, and intermediate portions continuously engageable by the cam means.

9. The combination of claim 8, wherein said cam means includes a friction drag surface continuously engageable with the deformable blades in undeformed positions thereof to yieldably hold the toggle member in said adjusted positions and spaced cam lobes engageable with the blades to effect elastic displacement thereof at the limit positions of the toggle member.

10. The combination of claim 9, including a plurality of terminal assemblies supported on the enclosure and electrically connected to the power control circuit, each of said terminal assemblies including a connector lug extending through the circuit board, a lug head connected to the connector lug and seated in a slot formed in the enclosure and means connected to the closure means for locking the lug head in said slots of the enclosure.

11. The combination of claim 6, including a plurality of terminal assemblies supported on the enclosure and electrically connected to the power control circuit, each of said terminal assemblies including a connector lug extending through the circuit board and means connected to the closure means for locking the connector lug in fixed position to the enclosure.

12. The combination of claim 6, wherein said tracks are secured to opposite faces of said substrate and said contactor includes a pair of confronting, inwardly biased contact elements for maintaining continuous wiping contact with said tracks.

13. The combination of claim 6 wherein the control circuit includes a heat generating element and wherein a portion of said mounting bracket is disposed in a heat transfer relation with said element whereby said bracket may serve as a heat sink for the control circuit.

14. A power controller having an enclosure, a controller lever mounted therein and a circuit board carrying a switch assembly actuated by the controller lever, means for holding the circuit board in a predetermined position with the enclosure, said switch assembly including a switch operating member anchored to the circuit board and having a pair of elastically deformable blades, each of said blades having a free end portion and an intermediate portion, movable contact means carried on said free end portions and fixed contact means anchored to the circuit board for engagement by the movable contact means, and cam means connected to the controller lever for continuous engagement with the intermediate portions of said deformable blades to actuate the switch assembly at limit positions of the controller lever and yieldably hold the controller lever in adjusted positions intermediate said limit positions.

15. The combination of claim 14, wherein said cam means includes a friction drag surface continuously engageable with the deformable blades in undeformed positions thereof to yieldably hold the controller lever in said adjusted positions and spaced cam lobes engageable with the blades to effect elastic displacement thereof at the limit positions of the controller lever.

16. The combination of claim 15, including closure means connected to the enclosure for retaining the controller lever in pivotal relation to the enclosure, terminal means supported on the enclosure and electrically connected to the switch assembly and means connected to the closure means for locking the terminal means in place on the enclosure.

17. The combination of claim 14, including closure means connected to the enclosure for retaining the controller lever in pivotal relation to the enclosure, terminal means supported on the enclosure and electrically connected to the switch assembly and means connected to the closure means for locking the terminal means in place on the enclosure.

18. A power regulator as claimed in claim 4 wherein said contactor means comprises a caliper member.

19. A potentiometer as claimed in claim 5 including a toggle member having a hand engagable control arm and a pivot shaft journaled within a housing, said contactor member being secured over a formation in the pivot shaft.

20. The combination of claim 9, wherein each deformable blade includes a dimple intermediate its length which is engaged by its associated cam lobe to bring the blade contact element into contact with its associated fixed contact element.

21. The combination of claim 12, wherein said tracks define arcuate paths formed proximate a correspondingly shaped marginal edge portion of the substrate and said contactor comprises a caliper-type member characterized by said contact elements being interconnected by a loop portion which encompasses the marginal edge portion of the substrate as said contact elements move along said tracks.

22. A power regulator as claimed in claim 1, wherein:

said toggle member comprises a control arm, a transverse pivot shaft journaled within mating recesses in the housing and a pair of angularly spaced cam lobes projecting internal of the housing and being axially spaced in the direction of the pivot shaft; and said switch comprises a pair of substantially parallel resilient blades, each blade having one fixed end and one free end including a contact, and each blade being continuously engaged by one of said cam lobes, said blade contacts being movable into and out of engagement with associated contact elements secured to said substrate in response to movement of the toggle member.

23. A power regulator as claimed in claim 22 wherein said blades are formed as part of an integral member secured to said substrate by anchoring tabs.

24. A power regulator as claimed in claim 23 wherein said blade fixed ends are joined to a common anchoring portion.

25. A power regulator as claimed in claim 22 wherein each blade includes a dimple intermediate its length which is engaged by its associated cam lobe to bring the blade contact into engagement with its associated contact element.

26. A power regulator as claimed in claim 22 wherein said blades are substantially perpendicular to both the toggle pivot shaft and the control arm when said arm is in a substantially central intermediate position between said on-off limit positions.

27. In a power regulator of the type having a nonconductive housing and a pivotal toggle member for varying the power supply to a load as the toggle member is displaced between opposite on-off limit positions, the improvement comprising:

a substrate secured within said housing and mounting selected components of a control circuit;

a switch member operable by the toggle member to shunt or open the control circuit as the toggle is displaced to the respective on-off limit positions;

a potentiometer forming a part of said control circuit and comprising:

a first continuous resistive track on said substrate;

a second continuous conductive track on the opposite face of said substrate from said first track, said second track defining a path substantially identical to the path of said first track and being separated therefrom by a thickness of said substrate;

a contactor member having a pair of confronting inwardly biased contact elements for frictionally engaging each of said first and second tracks, said contactor member being movable by displacement of the toggle member such that said contact elements wipingly engage the tracks along their respective paths as the toggle member is displaced between limit positions, thereby providing variable resistance for the control circuit, said contactor member comprising a metallic caliper member characterized by said contact elements being connected by a loop portion which encompasses the marginal edge portion of the substrate as said contact elements move along said tracks.

* * * * *

UNITED STATES PATENT AND TRADEMARK OFFICE

CERTIFICATE OF CORRECTION

PATENT NO. : 4,117,445

DATED : September 26, 1978

INVENTOR(S) : Luther M. Foreman, Samuel C. Heck, Bill R. Wall

It is certified that error appears in the above-identified patent and that said Letters Patent are hereby corrected as shown below:

In the heading of the patent, after "[56] References Cited", delete "3,871,328" and insert --2,871,328--.

Column 2, line 23, delete "contructed" and insert --constructed--.

Column 3, line 57, delete "miximum" and insert --maximum--.

Column 4, line 30, delete "with" and insert --With--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*